US011414725B2

(12) United States Patent
Andersson et al.

(10) Patent No.: US 11,414,725 B2
(45) **Date of Patent: *Aug. 16, 2022**

(54) USE OF PRE-OXIDIZED ILMENITE IN FLUIDIZED BED BOILERS

(71) Applicant: Improbed AB, Malmo (SE)

(72) Inventors: Bengt-Ake Andersson, Molnlycke (SE); Fredrik Lind, Torslanda (SE); Henrik Thunman, Partille (SE)

(73) Assignee: Improbed AB, Malmo (SE)

( * ) Notice: Subject to any disclaimer, the term of this patent is extended or adjusted under 35 U.S.C. 154(b) by 0 days.

This patent is subject to a terminal disclaimer.

(21) Appl. No.: 17/181,325

(22) Filed: Feb. 22, 2021

(65) Prior Publication Data

US 2021/0230714 A1 Jul. 29, 2021

Related U.S. Application Data

(63) Continuation of application No. 15/735,429, filed as application No. PCT/EP2016/062885 on Jun. 7, 2016, now Pat. No. 10,927,432.

(30) Foreign Application Priority Data

Jun. 15, 2015 (EP) ..... 15172217
Jun. 25, 2015 (EP) ..... 15173889

(51) Int. Cl.
*C22B 34/00* (2006.01)
*C22B 34/12* (2006.01)
*F23C 10/18* (2006.01)

(52) U.S. Cl.
CPC ..... *C22B 34/1209* (2013.01); *F23C 10/18* (2013.01); *F23C 2900/10004* (2013.01)

(58) Field of Classification Search
CPC ..... F23C 2900/10004; C22B 34/1209; C22B 34/1227
USPC ..... 423/594.1, 74
See application file for complete search history.

(56) References Cited

U.S. PATENT DOCUMENTS

| | | | |
|---|---|---|---|
| 3,764,651 A | 10/1973 | Henkel et al. | |
| 3,964,675 A | 6/1976 | Euchner, Jr. | |
| 4,843,981 A | 7/1989 | Goldbach et al. | |
| 4,960,057 A | 10/1990 | Ohshita et al. | |
| 6,808,390 B1 | 10/2004 | Fung et al. | |
| 10,927,432 B2 * | 2/2021 | Andersson | F23C 10/18 |
| 2004/0237909 A1 | 12/2004 | Krebs | |
| 2012/0199054 A1 | 8/2012 | Alban et al. | |
| 2013/0323654 A1 | 12/2013 | Ruottu | |
| 2018/0180281 A1 | 6/2018 | Andersson et al. | |
| 2018/0180282 A1 | 6/2018 | Andersson et al. | |

FOREIGN PATENT DOCUMENTS

| | | |
|---|---|---|
| CN | 1884049 A | 12/2006 |
| CN | 103031433 | 7/2014 |
| DE | 4007635 | 9/1991 |
| EP | 0185931 | 7/1986 |
| EP | 1013994 | 6/2000 |
| EP | 2762781 | 8/2014 |
| NZ | 196064 | 1/1986 |
| WO | WO 2016/202639 | 12/2016 |
| WO | WO 2016/202640 | 12/2016 |
| WO | WO 2016/202641 | 12/2016 |

OTHER PUBLICATIONS

Acharya et al. Heavy minerals placer deposits of Ekakula beach, Gahiramatha coast, Orissa, India. Resource Geology 1998; 48(2):125-136.

Corcoran, An analysis of ilmenite particles used as bed material for combustion of biomass in a CFB boiler, Master's Thesis in Sustainable Energy Systems, Chalmers University of Technology, Gothenburg, Sweden, 2013, T2013-397, 51 pages.

Filippou et al., Iron removal and recovery in the titanium dioxide feedstock and pigment industries. JOM 2009; 61(10):36-42.

Thunman et al., Using an oxygen-carrier as bed material for combustion of biomass in a 12-MWth circulating fluidized-bed boiler. Fuel Nov. 2013;113:300-309.

International Search Report and Written Opinion for PCT/EP2016/062885, dated Jan. 18, 2017, 13 pages.

International Search Report and Written Opinion for PCT/EP2016/062886, dated Aug. 17, 2016, 8 pages.

International Search Report and Written Opinion for PCT/EP2016/062887, dated Sep. 13, 2016, 10 pages.

* cited by examiner

*Primary Examiner* — Steven J Bos
(74) *Attorney, Agent, or Firm* — Casimir Jones, S.C.; Brian F. Bradley

(57) ABSTRACT

The invention relates to a method for starting up a fluidized bed boiler, such as a circulating fluidized bed (CFB) or a bubbling fluidized bed (BFB) boiler, for operation with a predetermined concentration of ilmenite particles in the bed material. The invention also relates to a method for pre-oxidizing ilmenite, to pre-oxidized ilmenite and to the use of pre-oxidized ilmenite in a fluidized bed boiler.

17 Claims, 4 Drawing Sheets

USE OF PRE-OXIDIZED ILMENITE IN FLUIDIZED BED BOILERS

Figure 1:
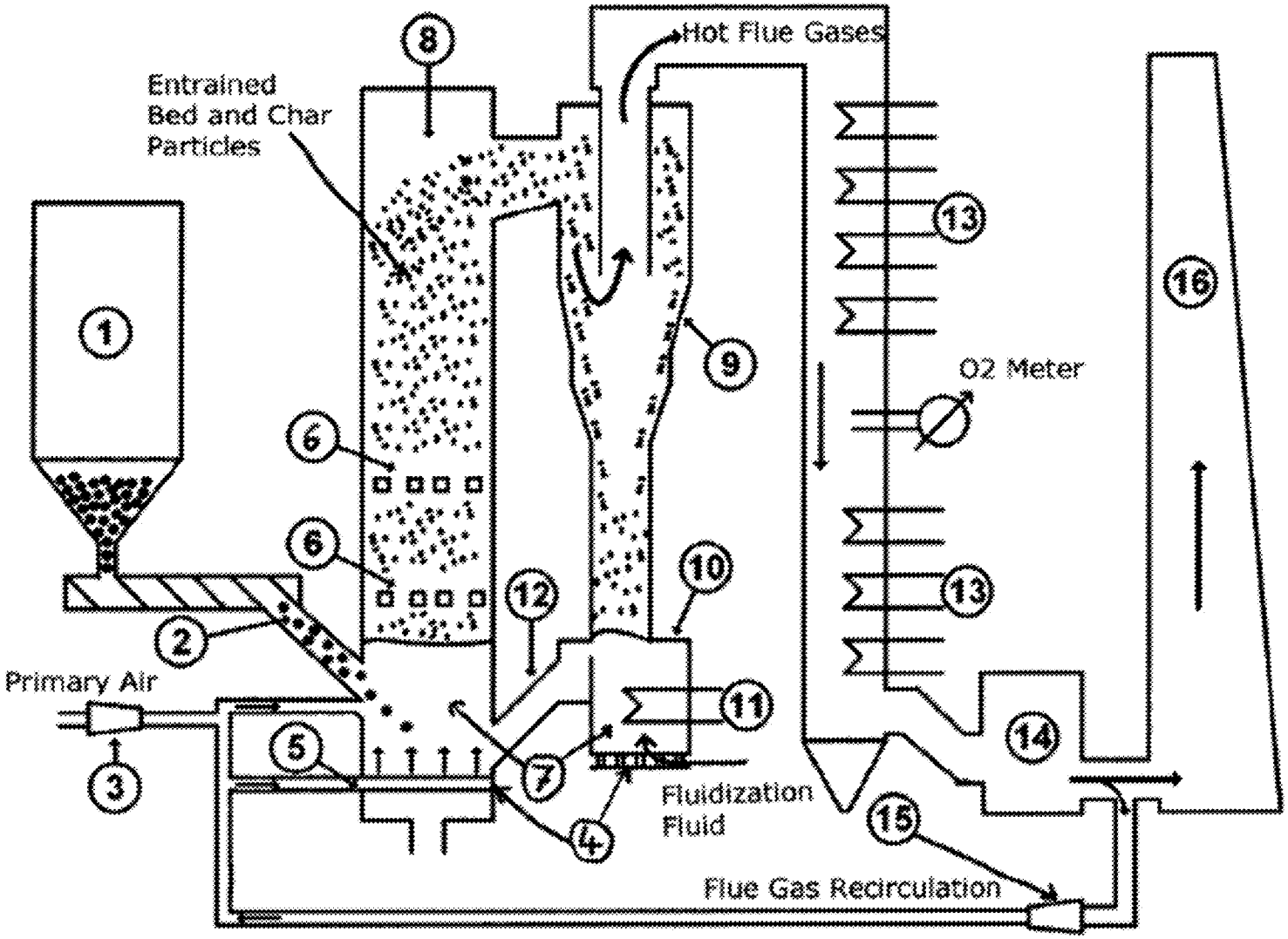

This application is a continuation of U.S. patent application Ser. No. 15/735,429, filed Dec. 11, 2017, allowed as U.S. Pat. No. 10,927,432, which is a § 371 US National Entry of International Application No. PCT/EP2016/062885, filed Jun. 7, 2016, which claims the benefit of European Application No. 15172217.0, filed Jun. 15, 2015, and European Application No. 15173889.5, filed Jun. 25, 2015.

The invention is in the field of fluidized bed combustion and relates to a method for starting up a fluidized bed boiler for operation with a predetermined concentration of ilmenite particles in the bed material. The invention further relates to a method for pre-oxidizing ilmenite particles, pre-oxidized ilmenite particles and the use of pre-oxidized ilmenite particles in a fluidized bed boiler.

In fluidized bed combustion (FBC) the fuel is suspended in a hot fluidized bed of solid particulate material. In this technique a fluidizing gas is passed with a specific fluidization velocity through a solid particulate bed material. At very low gas velocities, the bed remains static. Once the velocity of the fluidization gas rises above the minimum fluidization velocity at which the force of the fluidization gas balances the gravity force acting on the particles, the solid bed material behaves in many ways similar to a fluid and the bed is said to be fluidized. Two major types of fluidized bed combustion systems which are in practical use are bubbling fluidized bed (BFB) boilers and circulating fluidized bed (CFB) boilers.

In the BFB technique a bed material, typically silica sand with an average particle size between 0.6-1.3 mm, is applied as a heat carrier. In BFB combustion, the fluidization gas velocity is above the minimum fluidization velocity leading to the formation of bubbles in the bed, facilitating the transport of the gas through the bed material and allowing for a better control of the combustion conditions (better mixing and hence more even temperature distribution in the bed) when, e.g., compared with grate combustion. In BFB combustion, unburned fuel can be comprised in the fly ash which is entrained by the flue gas. This issue was addressed by the development of CFB boilers, which allow to recirculate unburned fuel and further allow for more heat exchangers. In CFB combustion the fluidization gas is passed through the bed material, typically silica sand particles with an average particle size in the range 0.05-0.4 mm, at a fluidization velocity where at least the majority of solid particles are carried away by the fluidization gas stream. The particles are then separated from the gas stream, typically by means of a cyclone, and circulated back into the furnace, usually via a loop seal.

Usually oxygen containing gas, typically air, is used as the fluidizing gas (so called primary fluidizing gas or primary air) and passed from below the bed through the bed material, thereby acting as a source of oxygen required for combustion. Even though fluidized beds are seen as systems providing good mixing between solid fuels and the oxidizer, in particular when compared to grate boilers, mixing between fuel and oxidizer is not perfect. To compensate for uneven mixing conditions, it is necessary to supply oxygen in excess of the amount required by stoichiometry in order to achieve essentially complete combustion.

From the prior art it is known to replace a fraction of the silica sand bed material with ilmenite in the CFB process (H. Thunman et al., Fuel 113 (2013) 300-309). The natural occurring mineral ilmenite consists mainly of iron titanium oxide ($FeTiO_3$) which can be repeatedly oxidized and reduced and thus acts as a redox material. Due to this reducing-oxidizing feature of ilmenite, the material can be utilized as an oxygen carrier in circulating fluidized bed (CFB) combustion and the prior art has reported that the CFB process can be carried out at lower air to fuel ratios with the bed material comprising ilmenite particles. The term air to fuel ratio ($\lambda$) is commonly understood in the art and denotes the amount of air that is fed in relation to the fuel in a combustion unit. It is defined as $$\lambda = \frac{m_{oxygen,provided}}{m_{oxygen,stoichiometry}}$$

where $m_{oxygen,provided}$ is the total mass of oxygen that is fed as combustion air to the furnace; and $m_{oxygen,stoichiometry}$ is the mass of oxygen which is needed to reach stoichiometric combustion of the fuel fed to the furnace.

The object of the invention is to provide means that allow for the safe use of ilmenite particles in a fluidized bed boiler.

This object is solved by the features of the independent claims. Advantageous embodiments are defined by the features of the dependent claims.

The invention is based on two important recognitions.

In a first step, the invention has recognized that ilmenite is not fully oxidized in its natural state and that a sudden and drastic temperature increase in the fluidized bed can occur when a fluidized bed boiler is started up with the bed material comprising fresh ilmenite particles. Such a local temperature increase during the start-up of a fluidized bed boiler can lead to severe damage to the furnace or the nozzles of the gas ports and may further result in a sintered bottom bed and production stop.

In a second step, the invention has recognized that by pre-oxidizing ilmenite particles the negative effects of an undesired temperature increase in the bed can be prevented or at least greatly reduced.

Without wishing to be bound by theory, it is contemplated that the sudden temperature increase during startup of the fluidized bed boiler with fresh ilmenite particles can be attributed to the rapid exothermal oxidation of the ilmenite and that by pre-oxidizing the ilmenite particles, negative effects due to the exothermal reaction can be avoided. Equation 1 shows that the theoretical highest heat release from the oxidation of ilmenite to its most-oxidized state of "pseudobrookite plus rutile" is 235 kJ/mole O.

$$2FeTiO_3 + \frac{1}{2}O_2 \leftrightarrow Fe_2TiO_5 + TiO_2\left(\Delta H = -235\frac{kJ}{mol\ O}\right) \quad \text{(Eq. 1)}$$

First, several terms are explained in the context of the invention.

The invention uses ilmenite particles. Ilmenite is a natural occurring mineral which consists mainly of iron titanium oxide. In the context of the invention, fresh ilmenite particles are ilmenite particles which are not fully oxidized. The term pre-oxidation refers to a controlled process in which fresh ilmenite particles are oxidized to raise their oxidation state. Pre-oxidized ilmenite particles are therefore ilmenite particles which have undergone such a controlled oxidation process. In the context of the invention, it is not necessary that the ilmenite particles are pre-oxidized to their most-oxidized state of "pseudo-brookite plus rutile". The invention has recognized that the initial oxidation reaction of fresh ilmenite particles is rapid and that it is sufficient to raise the oxidation state of the ilmenite particles to control this initial oxidation reaction.

In the context of the invention, the ilmenite particles can preferably be selected from the group consisting of rock ilmenite and sand ilmenite. Rock ilmenite particles are particularly preferred.

Rock ilmenite is available in igneous rock deposits, e.g. in Canada, Norway and China. The content of TiO2 in rock ilmenite is rather low (30-50 wt. %), but its iron content is relatively high (30-50 wt. %) (see Filippou. D, Hudon G. Iron removal and recovery in the titanium dioxide feed-stock and pigment industries. JOM, volume 61, issue 10, 36-42, 2009). The rock ilmenite is mined and upgraded via crushing and separation from impurities. The particle density (specific gravity) of rock ilmenite is in the range 4000-4400 kg/m3, the bulk density 1800-2600 kg/m3. Rock ilmenite particles have a sphericity (shape factor) <0.8. A typical sphericity value for rock ilmenite is about 0.7. The sphericity is defined as the surface area of the particle divided by the surface area of a sphere of the same volume.

Ilmenite sands can be found in placer deposits of heavy minerals occurring for example in South Africa, Australia, North America and Asia (see Filippou. D, Hudon G. Iron removal and recovery in the titanium dioxide feedstock and pigment industries. JOM, volume 61, issue 10, 36-42, 2009). Generally sand ilmenites stem from weathered rock deposits. The weathering causes the iron content to decrease while increasing the content of TiO2. Due to the natural iron oxidation and dissolution, hence also called altered ilmenite, the TiO2 content can be as high as 90 wt %. In this case the alteration product is called leucoxene (see Filippou. D, Hudon G. Iron removal and recovery in the titanium dioxide feedstock and pigment industries. JOM, volume 61, issue 10, 36-42, 2009). The particle density (=specific gravity) of sand ilmenite is in the range 4200-4600 kg/m3, the bulk density 2400-2800 kg/m3 and the angle of repose 30-32°. The sphericity of sand ilmenites has been reported to range from 0.8 to 1 with the mean factor value of 0.91 (Bhaskar Chandra et al. Heavy minerals placer deposits of Ekakula beach, Gahiramatha coast, Orissa, India. Resource Geology, Vol. 48, No. 2, 125-136, 1998.).

The invention provides a method for starting up a fluidized bed boiler for operation with a predetermined concentration of ilmenite particles in the bed material, wherein pre-oxidized ilmenite particles are used for reaching the predetermined concentration of ilmenite particles in the bed material.

In the context of the invention, the term bed material describes material intended to create the fluidized bed in the CFB or BFB system. The term bed material encompasses conventional bed materials, such as silica sand, as well as ilmenite particles. The term fuel describes the materials that are to be combusted and comprises any fuel known to be combustible in fluidized bed boilers. Typical fuel materials are wood, agricultural biomass, coal or sludge. Preferred fuels are selected from the group consisting of bio-mass, waste-based fuels, coal and petcokes.

In a preferred embodiment, using pre-oxidized ilmenite particles for reaching the predetermined concentration of ilmenite particles in the bed material comprises providing pre-oxidized ilmenite particles to the boiler. This means that the ilmenite particles have been pre-oxidized outside the boiler, preferably using the inventive method for producing pre-oxidized ilmenite particles described further below. Preferably, pre-oxidized ilmenite particles are provided to the boiler at the predetermined concentration of ilmenite particles in the bed material. By providing all or a portion of the ilmenite particles as pre-oxidized ilmenite particles to the boiler, the rapid increase in bed temperature can be avoided or at least sufficiently reduced to make it controllable within the boiler. It is particularly preferred that the pre-oxidized ilmenite particles are provided to the boiler before the bed material is heated or preheated, preferably at the predetermined concentration of ilmenite particles in the bed material. A particular advantage of this embodiment is that the boiler can essentially be started up following the usual routine utilized for starting up fluidized bed boilers with conventional bed material, such as silica sand without the need for further pre-oxidation of ilmenite particles inside the boiler. In a particularly preferred embodiment, using pre-oxidized ilmenite particles for reaching the predetermined concentration of ilmenite particles in the bed material consists of providing pre-oxidized ilmenite particles to the boiler.

In another preferred embodiment, using pre-oxidized ilmenite particles for reaching the predetermined concentration of ilmenite particles in the bed material comprises providing fresh ilmenite particles to the boiler and pre-oxidizing said fresh ilmenite particles in the boiler. This means that the fresh ilmenite particles undergo a controlled oxidation process in the boiler. Preferably, the controlled oxidation process can be achieved by gradually feeding fresh ilmenite particles to the boiler. By gradually providing the ilmenite particles to the boiler, only small amounts of ilmenite particles are pre-oxidized at a time and the corresponding heat release can be controlled. It is particularly preferred that the fresh ilmenite particles are gradually fed to the boiler. Since the pre-oxidation takes place gradually inside the furnace, this preferred embodiment also has the advantage that the boiler is not accidentally started up with a large amount of fresh ilmenite which has not previously been pre-oxidized. Preferably, the ilmenite particles can be fed to the boiler at a rate to keep the temperature in the bed essentially constant. Thus, the monitored temperature in the bed can be used to coordinate the feeding rate of the ilmenite particles. In a particularly preferred embodiment, using pre-oxidized ilmenite particles for reaching the predetermined concentration of ilmenite particles in the bed material consists of providing fresh ilmenite particles to the boiler and pre-oxidizing said fresh ilmenite particles in the boiler.

Furthermore, it is possible to combine the above embodiments by providing a portion of the ilmenite particles as pre-oxidized ilmenite particles to the boiler as described above and providing the remaining ilmenite particles as fresh ilmenite particles to the boiler and pre-oxidizing said fresh ilmenite particles in the boiler as described above. This allows greater flexibility for the startup procedure.

Preferably, the method for starting up a fluidized bed boiler further comprises the steps of:

a) providing bed material to the boiler;
b) preheating the bed material;
c) monitoring the temperature in the bed;
d) after the temperature in the bed has reached a predetermined fuel feeding temperature, batch-feeding fuel until ignition is achieved;
e) after ignition is achieved, starting continuous feeding of fuel and increasing the fuel feeding rate until the predetermined operating temperature in the bed is reached.

Preferred methods of preheating the bed material comprise preheating through overbed burners, which heat the bed from above, for example by thermal radiation; and preheating through underbed burners, e.g. by preheating the primary fluidizing gas to preheat the bed. Primary fluidizing gas is the gas used for fluidizing the bed material in the boiler. Primary fluidizing gas is commonly injected into the furnace via an array of bottom nozzles below the bed. Preferably an oxygen containing fluidizing gas is used. Air or a mix of air and recirculated flue gases is a particularly preferred fluidizing gas in the context of the invention. In this preferred embodiment, the primary fluidizing gas is essentially heated to accumulate the heat needed to reach ignition when the fuel feeding is started. Preferably the primary fluidizing gas is preheated using a start burner. Further preferably, the start burner can be placed in the wind box of the boiler. As the heated fluidizing gas passes upward through the bottom nozzles into the bed, heat is accumulated in the bed.

Preferably, the temperature in the bed can be monitored through shielded thermocouples installed in the bed (such as thermocouples located in thermowells immersed in the bed) or through infrared cameras.

Preferably, when the temperature in the bed has reached a predetermined fuel feeding temperature, which is below a predetermined operating temperature in the bed, batch-feeding of fuel to the furnace is started and continued until ignition is achieved. Preferably, the predetermined fuel feeding temperature in the bed is between 500° C. and 900° C., more preferably between 500° C. and 600° C., further preferably between 530° C. and 580° C., more preferably around 550° C. Preferably, the predetermined operating temperature in the bed can preferably be between 750° C. and 950° C., more preferably between 800° C. and 900° C., most preferably between 850° C. and 900° C. Batch-feeding of fuel in this context means that a small amount of fuel is fed to the furnace and the operator waits to see if ignition is achieved. If ignition is not achieved, preheating is continued and after some time another batch of fuel is fed to the furnace. This process is continued until ignition is achieved. The term ignition is commonly understood in the art. Ignition is usually signaled by a temperature increase in the bed, which is more rapid than the comparatively smooth temperature increase from only preheating the primary fluidizing gas, for example by using a start burner as described above. After ignition is achieved, preheating of the fluidizing gas can be stopped and continuous feeding of fuel is started and the fuel feeding rate is increased until the predetermined operating temperature in the bed is reached.

In preferred embodiments, pre-oxidized ilmenite particles are provided to the boiler before the bed material is preheated. Advantageously, the pre-oxidized ilmenite particles can be provided in step a), above; preferably at the predetermined concentration of ilmenite particles in the bed material. Preferably, the bed material provided in step a) can further comprise an inert bed material, preferably silica sand.

Preferably, fresh ilmenite particles are provided to the boiler after the predetermined operating temperature in the bed is reached. This can have the advantage that the boiler can be started up with conventional bed material, such as e.g. silica sand, to reach a stable operating temperature before ilmenite particles are provided to the boiler until the predetermined concentration of ilmenite particles in the bed is reached. Advantageously, the fresh ilmenite particles can be provided to the boiler after step e), above. Preferably, the bed material provided in step a) above consists of silica sand. Preferably, the fresh ilmenite particles are gradually provided to the boiler. It is particularly preferred that the fresh ilmenite particles are provided to the boiler at a rate to keep the operating temperature in the bed essentially constant. This means that the operating temperature can be monitored and used to adjust the feeding rate of the fresh ilmenite particles, which has the advantage that the bed remains at a stable operating temperature throughout the pre-oxidation of ilmenite particles.

Preferably, bed material provided in step a) can be gradually replaced with ilmenite particles until the predetermined concentration of ilmenite particles in the bed material is reached, preferably by coordinating the feeding rate of ilmenite particles and the rate of bottom bed ash removal. This is a convenient way, to reach high predetermined concentrations of ilmenite particles in the bed material and may be utilized to replace essentially the entire bed material provided in step a) with ilmenite bed particles in order to reach a predetermined concentration of 100 wt. % ilmenite particles in the bed. Preferably, the bed material provided in step a) comprises an inert bed material, preferably silica sand.

In the context of the inventive method, the predetermined concentration of ilmenite particles in the bed material can preferably be at least 10 wt. %, preferably at least 20 wt. %, further preferably at least 30 wt. %, further preferably at least 40 wt. %, further preferably at least 50 wt. %, further preferably at least 60 wt. %, further preferably at least 70 wt. %, further preferably at least 80 wt. %, further preferably at least 90 wt. %, most preferably 100 wt. % of the weight of the bed material.

Preferably, the fluidized bed boiler is selected from the group consisting of bubbling fluidized bed (BFB) boilers and circulating fluidized bed (CFB) boilers.

Preferably, the ilmenite particles are selected from the group consisting of rock ilmenite and sand ilmenite, preferably the ilmenite particles are rock ilmenite particles. Preferably the ilmenite particles may have an average particle size between 50 μm and 400 μm, more preferably between 100 μm and 400 μm. These particle sizes are particularly advantageous when the ilmenite is used with CFB boilers. Alternatively, the ilmenite particles may preferably consist of particles with an average particle size between 0.1 mm and 1.8 mm, more preferably between 0.3 mm and 1.0 mm, most preferably between 0.4 mm and 0.6 mm. These particle sizes are particularly advantageous when the ilmenite is used with BFB boilers. Particle size (dp) can be measured by mechanical sieving. The mass captured on each sieve is weighed and the average particle size (<dp>) is calculated as mass weighted average value.

The invention also provides a method for producing pre-oxidized ilmenite particles inside a furnace, comprising the steps of:

a) heating the furnace to a predetermined temperature;
b) maintaining an oxidizing environment inside the furnace;
c) continuously feeding fresh ilmenite particles to the furnace;
d) pre-oxidizing the ilmenite particles by subjecting the ilmenite particles to the oxidizing environment inside the furnace at the predetermined temperature;
e) continuously removing pre-oxidized ilmenite particles from the furnace.

The predetermined temperature in the context of the method for producing pre-oxidized ilmenite is the temperature in the reaction zone of the furnace, where the majority of the pre-oxidation reactions occur.

An oxidizing environment is an environment in which oxidizing conditions prevail. Preferably, the oxidizing environment inside the furnace is maintained by feeding oxygen containing gas into the furnace. Preferably, the concentration of oxygen in the oxygen containing gas can be between 0.5 vol. % and 30 vol. %, further preferably between 2 vol. % and 21 vol. %, further preferably between 2 vol. % and 10 vol. %, more preferably between 3 vol. % and 9 vol. %, more preferably between 3 vol. % and 8 vol. %. In a preferred embodiment, the oxygen containing gas is air or oxygen mixed with recirculated wet or dry flue gases.

By continuously feeding, fresh ilmenite particles to the furnace and continuously removing pre-oxidized ilmenite particles from the furnace, a continuous production of pre-oxidized ilmenite particles can be achieved. Furthermore, it is possible to control the oxidation rate by gradually pre-oxidizing ilmenite particles.

Preferably, the predetermined temperature is between 500° C. and 1000° C., preferably between 700° C. and 950° C., more preferably between 750° C. and 900° C., most preferably between 800° C. and 900° C.

The temperature may be measured by any suitable means. Preferred means of measuring the temperature is through shielded thermocouples or by infrared measurement.

The method can preferably comprise monitoring a temperature inside the furnace and further preferably adjusting the feeding rate of fresh ilmenite particles to the furnace and/or the removal rate of pre-oxidized ilmenite particles to keep the temperature in the furnace essentially constant. The temperature, which is monitored inside the furnace, may preferably be the temperature of the environment in the furnace or the temperature of the ilmenite particles in the furnace.

The invention has recognized that the initial oxidation reaction of ilmenite particles is rapid. Without wishing to be bound by theory, it is contemplated that the reaction is mass-transfer controlled and not kinetically controlled. This allows for flexibility in terms of the oxygen content in the oxidizing environment and the duration of the pre-oxidation, where the duration can be shortened while increasing the oxygen content in the oxidizing environment and vice versa. In preferred embodiments the ilmenite particles are subjected to the oxidizing environment for:

i) not more than 12 hours, preferably not more than 10 hours, further preferably not more than 8 hours, further preferably not more than 5 hours, further preferably not more than 3 hours, further preferably not more than 2 hours, most preferably not more than 60 minutes; and/or ii) at least 5 minutes, preferably at least 10 minutes, more preferably at least 20 minutes, most preferably at least 30 minutes;

wherein each lower limit can be combined with each upper limit to form a suitable range.

In a particularly preferred embodiment, the ilmenite particles are subjected to the oxidizing environment for a duration of 30-60 minutes, preferably at a temperature between 800° C. and 900° C. Further preferably, the oxidizing environment inside the furnace is maintained by feeding oxygen containing gas with 3-8 vol. % oxygen into the furnace.

Preferably, the ilmenite particles are selected from the group consisting of rock ilmenite and sand ilmenite, preferably the ilmenite particles are rock ilmenite particles.

Preferably, the ilmenite particles can be agitated to facilitate contact with the oxygen in the oxidizing environment. Any suitable means for agitation is contemplated. Preferably, the ilmenite is agitated by stirring, rotation or by passing a gas stream through the ilmenite particles.

Preferably, the above described method for producing pre-oxidized ilmenite particles may be carried out using a fluidized bed boiler, preferably a bubbling fluidized bed (BFB) boiler, more preferably a circulating fluidized bed (CFB) boiler. Preferably, fresh ilmenite is continuously fed to the furnace of the fluidized bed boiler and pre-oxidized ilmenite is removed from the bottom of the boiler, e.g. by using cooled screw feeders for bottom ash removal. In a preferred embodiment, the mass flow and control of the product stream is balanced by the differential pressure over the bed. The oxidizing environment inside the furnace of the fluidized bed boiler is maintained by passing an oxygen containing gas into the furnace, preferably primary fluidizing oxygen containing gas, such as air, further preferably also secondary oxygen containing gas, such as secondary air. In the context of the invention, the term secondary oxygen containing gas denotes all oxygen containing gas passed into the furnace which is not primary oxygen containing gas. Fluidized bed systems are well known for the high heat transferring properties within the bed. This allows for rapid heating and pre-oxidation of the ilmenite. Since the amount of fresh ilmenite fed to the boiler only constitutes a few percent of the total bed mass, the heat formation during the oxidation of the fresh ilmenite can be controlled. The preferred temperature in the furnace can be 800° C. to 900° C. Preferably, fresh ilmenite particles can be fed to the furnace at a rate to keep the bed temperature below or equal to a predetermined temperature in the furnace, wherein the predetermined temperature is preferably 800° C. to 900° C. The furnace can preferably be started up using the inventive method described above.

Further preferably, the above method for producing pre-oxidized ilmenite particles can be carried out using a rotary kiln. Rotary kilns are pyroprocessing devices well known in the prior art. They are, e.g., commonly used for upgrading iron ores and in cement production. A rotary kiln system generally comprises a tubular furnace that is heated on the inside and rotated slowly. The furnace is generally slightly leaning at an angle to create a mass motion of the feedstock inside the furnace. In a preferred embodiment, a rotary kiln furnace can be utilized for continuous pre-oxidation of ilmenite. In this preferred embodiment, the furnace is heated to a temperature between 800° C. and 900° C. during air excess. Fresh ilmenite is continuously fed from one side of the furnace and pre-oxidized ilmenite is continuously taken out at the other end of the furnace. The residence time of the ilmenite in the furnace can be adjusted depending on the speed of the rotation of the furnace and the length of the furnace.

The invention further relates to pre-oxidized ilmenite particles. The pre-oxidized ilmenite particles are preferably obtainable by the method for producing pre-oxidized ilmenite particles described above. The pre-oxidized ilmenite particles may preferably have an average particle size between 50 μm and 400 μm, more preferably between 100 μm and 400 μm. These particle sizes are particularly advantageous when the pre-oxidized ilmenite particles are used with CFB boilers. Alternatively, the pre-oxidized ilmenite particles may preferably have an average particle size between 0.1 mm and 1.8 mm, more preferably between 0.3 mm and 1.0 mm, most preferably between 0.4 mm and 0.6 mm. These particle sizes are particularly advantageous when the pre-oxidized ilmenite particles are used with BFB boilers. The particles sizes can be obtained and measured by sieving. Preferably, the pre-oxidized ilmenite particles are selected from the group consisting of pre-oxidized rock ilmenite and pre-oxidized sand ilmenite. Pre-oxidized rock ilmenite is particularly preferred.

The invention also comprises the use of the pre-oxidized ilmenite particles as bed material in a fluidizing bed boiler, such as a bubbling fluidized bed (BFB) boiler or a circulating fluidized bed (CFB) boiler. In particular, the invention contemplates using the pre-oxidized ilmenite particles in the method for starting up a fluidized bed boiler described above. Preferably, the pre-oxidized ilmenite particles are selected from the group consisting of pre-oxidized rock ilmenite and pre-oxidized sand ilmenite. Pre-oxidized rock ilmenite is particularly preferred. Most preferably, the pre-oxidized ilmenite particles are obtainable by the method for producing pre-oxidized ilmenite particles described above.

In the following, advantageous embodiments will be explained by way of example.

It is shown in

Figure 2:
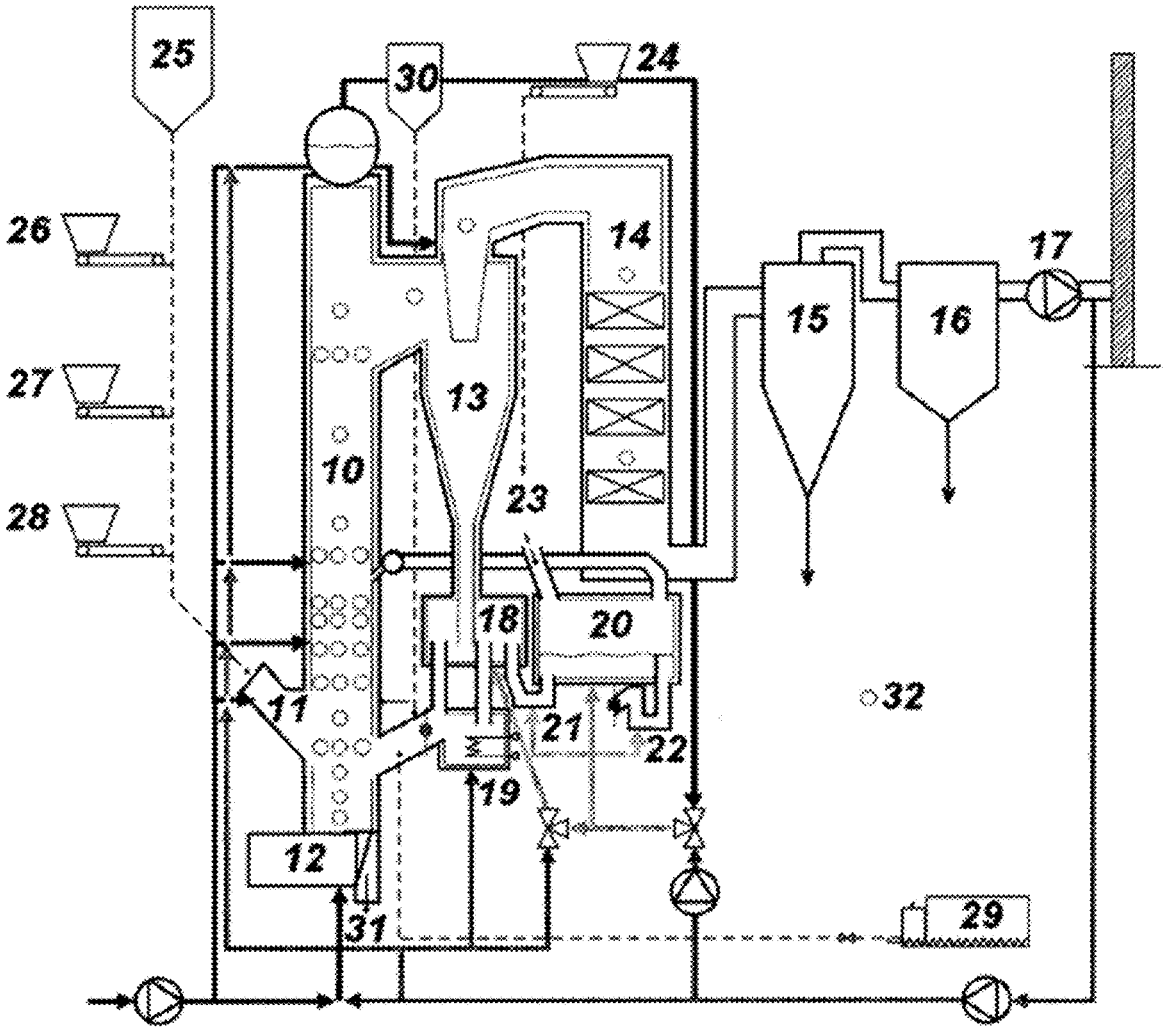
Figure 3:
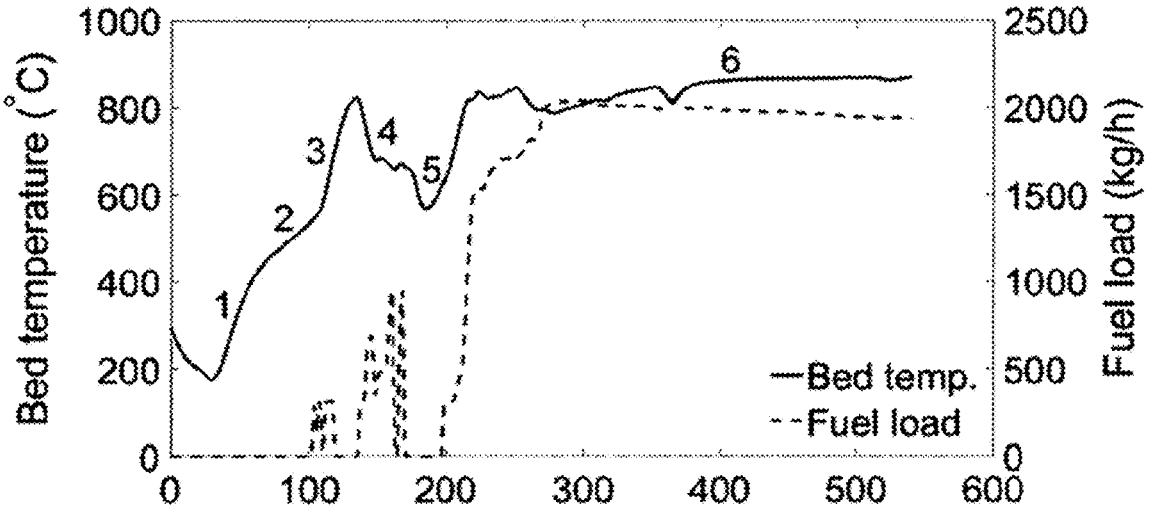
Figure 4:
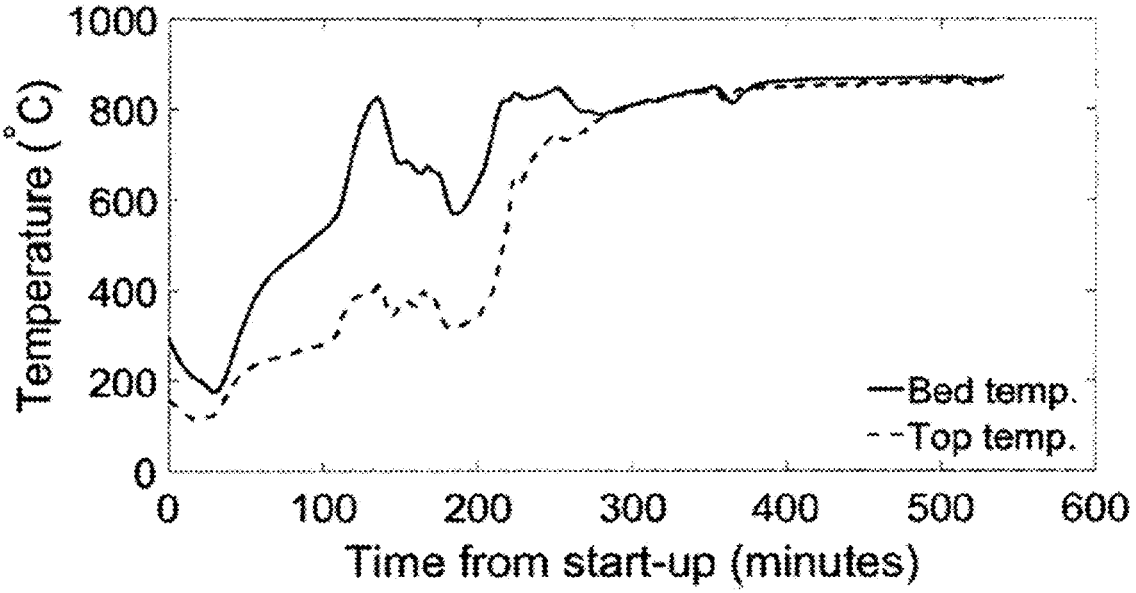
Figure 5:
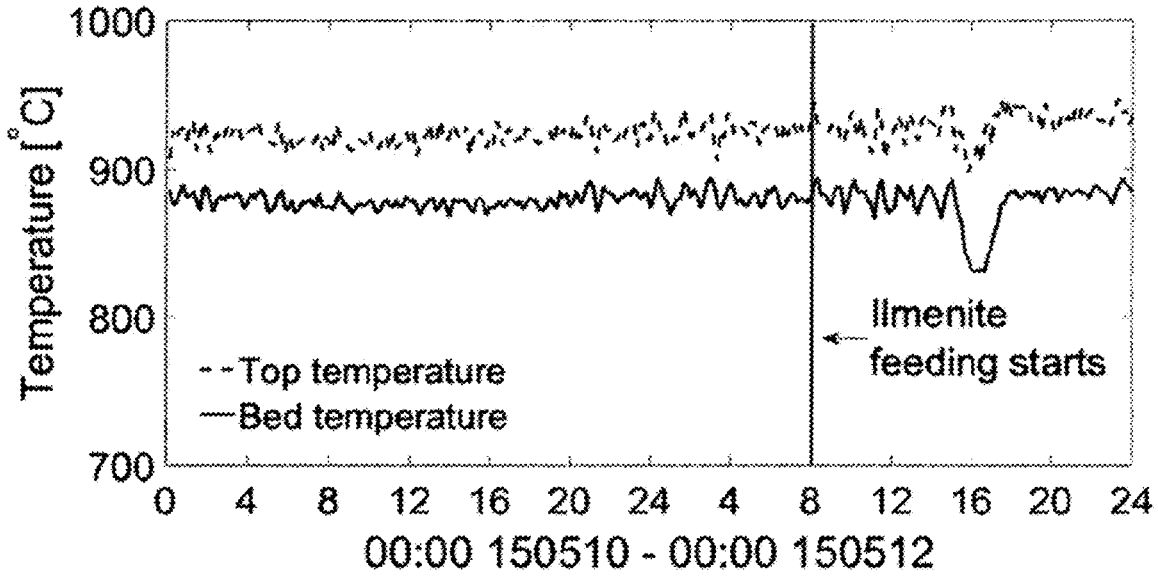
Figure 6:
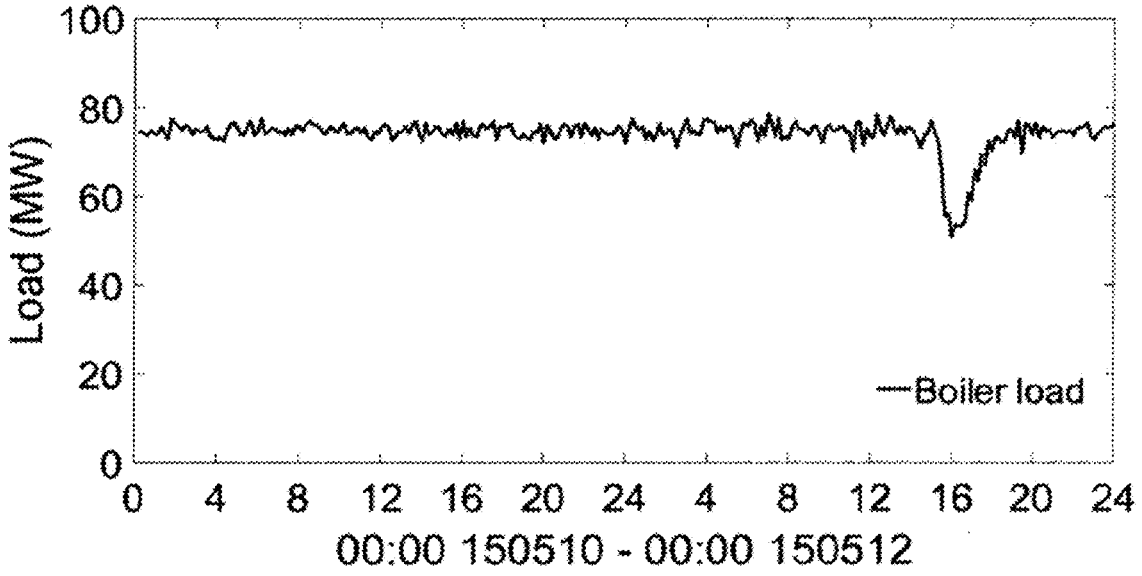

FIG. 1: a schematic drawing of a CFB boiler;

FIG. 2: a schematic drawing of the 12 $MW_{th}$ CFB boiler used for CFB experiments;

FIG. 3: temperature profile in the bottom bed and mass flow of fuel fed during the startup sequence using fresh rock ilmenite in the Chalmers 12 $MW_{th}$ CFB boiler;

FIG. 4: bottom bed temperature and top temperature as a function of operating time during the startup sequence using fresh rock ilmenite in the Chalmers 12 $MW_{th}$ CFB boiler;

FIG. 5: bottom bed temperature and top temperature as a function of operating time during silica sand operation and during the pre-oxidation procedure for ilmenite in a commercially fired CFB boiler;

FIG. 6: boiler load as a function of operating time during silica sand operation and during the pre-oxidation procedure for ilmenite in a commercially fired CFB boiler.

COMPARATIVE EXAMPLE

Normal Startup Sequence for Fluidized Bed Boilers

The normal startup procedure for fluidized bed combustors is composed for operation with silica-sand as bed material. This procedure is initiated by preheating the primary air which is used for the fluidization of the bed via a start burner which is placed in the wind box. The heated air is flowing through the bottom nozzles and into the silica-sand bed, heat is accumulated in the bed and the temperature of the bed is monitored. When the bed temperature reaches around 550° C. a batch of fuel is injected, usually by starting the fuel feeding system with a pulse. The sequence of feeding fuel batch-wise is usually carried out until a so called ignition is achieved. The ignition is usually reached when the temperature starts to increase more rapidly in the bed in contrast to when only the start burner is used for heating, which generates a smoother temperature profile. The start burner is turned off and the fuel feeding is put into continuous feeding mode with increasing mass flow of fuel until the normal operating temperature in the bed is reached, which may be around 850-900° C.

Example 1

Startup of the Chalmers Boiler using Ilmenite as Bed Material

The Chalmers 12 $MW_{th}$ CFB-boiler is shown in FIG. 2. Reference numerals denote:

10 furnace
11 fuel feeding (furnace)
12 wind box
13 cyclone
14 convection path
15 secondary cyclone
16 textile filter
17 fluegas fan
18 particle distributor
19 particle cooler
20 asifier
21 particle seal 1
22 particle seal 2
23 fuel feeding (gasifier)
24 fuel hopper (gasifier)
25 hopper
26 fuel hopper 1
27 fuel hopper 2
28 fuel hopper 3
29 sludge pump
30 hopper
31 ash removal
32 measurement ports The influence of the bed temperature during oxidation of fresh rock ilmenite is illustrated in FIG. 3. FIG. 3 shows the temperature profile in the bottom bed and the amount of fuel fed from the startup sequence until normal operation is reached in the Chalmers 12 $MW_{th}$ CFB-boiler using fresh rock ilmenite as bed material. The temperature in the bed is slowly increased by the preheated primary air stream, similar to ordinary silica-sand startup (1). When the bed temperature of 550° C. is reached (2), a very small amount of fuel is fed to the furnace. The bed temperature is starting to increase more rapidly and the start burner is turned off and as the temperature in this case is quickly increasing further the fuel is also completely turned off (3). It is not a normal procedure to turn off the fuel feeding at this time, usually there is a need for increasing the fuel feed to reach a higher bed temperature. However, as can be seen in FIG. 3, the temperature is increasing drastically even though the fuel is turned off. At this stage, recirculated flue gases are fed to the bottom nozzles to cool the bed. Without wishing to be bound by theory, it is contemplated that this phenomenon of temperature increase is strongly coupled to the exothermic oxidation of the fresh rock ilmenite bed (cf. Eq. 1). After a while, the temperature drops 150° C., the fuel feeding is restarted (4), however, this time the temperature decreases too much and no ignition is achieved and the start burner is restarted. At around 600° C., the fuel feeding is restarted and ignition is reached and the temperature starts to increase (5). This time the fuel feeding has to be increased continuously to reach the operating temperature of the bed. The second startup clearly follows the normal startup procedure for ordinary silica-sand. Without wishing to be bound by theory, the conclusion is that in this case the pre-oxidation happened during the first startup-sequence. During the second start-up attempt the ilmenite particles were already pre-oxidized, which is why the usual startup sequence could be followed, leading to the conclusion that if the ilmenite is pre-oxidized the exothermic oxidation can be avoided. At around 400 minutes after the first startup trial the boiler is running under normal temperature and fuel conditions (6).

The oxidation of the rock ilmenite resulting in a local heat release can be seen in FIG. 4, where the bottom bed temperature and top temperature of the boiler is shown as a function of operating minutes. There is a drastic temperature increase within the bed whereas the temperature above the bed is only increasing moderately. This indicates that the oxidation of the fresh rock ilmenite occurs locally in the bed leading to a very rapid temperature increase. During this part of the startup procedure for a CFB boiler, the bed is a stationary bubbling bed where there are usually few or commonly no heat transferring surfaces present. These data indicate that the oxidation has to be controlled to enable a safe startup of a fluidized bed boiler when rock ilmenite is used as bed material.

Example 2

Pre-oxidation by Gradual Feeding of Rock Ilmenite During Startup

A safe startup procedure for using rock ilmenite in fluidized bed boilers has been developed and tested in a commercially fired boiler. This procedure is based on a gradual increase of the rock ilmenite concentration in the boiler, so that the exothermic oxidation reaction and the resulting heat formation can be controlled. The 75 $MW_{th}$ CFB boiler used for the test is equipped with two storing silos (one for silica-sand and one for rock ilmenite) and separate lines for introducing the bed materials to the boiler. This setup allows the feeding of two different bed materials independent of each other. The startup procedure of the boiler is initiated with 100 wt. % of the ordinarily used silica-sand as bed material. This means that the boiler is first started according to the sequence in Comparative example 1. When a stable operating temperature is achieved, a continuous mass flow of rock ilmenite is initiated to the boiler using the second feeding line. FIG. 5 shows the temperature profile in the bottom bed and in the top of the boiler during operation with solely silica-sand and during operation with gradual increase of ilmenite. As can be seen in FIG. 5 there is no clear changes in either bottom bed or top temperatures when the ilmenite is introduced, with the exception at around 16:00. This is due to a standard procedure for water sooting of the convection path and the boiler load is reduced by the operators. This can also be seen in FIG. 6 where the boiler load is plotted as a function of the operating time. This shows in comparison to the operation with solely ilmenite in the CTH-boiler that the temperature in the bottom bed can be controlled when using this pre-oxidizing method during the startup of the boiler. The mass flow of rock ilmenite to reach safe operation is site dependent and is in this procedure calculated according to the boiler dimensions, fluid dynamics, boiler bed pressure and heat transferring surfaces. The mass flow of rock ilmenite can also be adjusted so that the operating temperature in the bed is kept essentially constant. The rock ilmenite concentration in the bed can be increased up to 100 wt. % by compensating the feeding rate of rock ilmenite with the bottom bed ash removal system.

Example 3

Start-Up Using Pre-Oxidized Ilmenite

Pre-oxidized ilmenite, for example pre-oxidized rock ilmenite, is provided as the sole bed material to a conventional CFB boiler as shown in FIG. 1. Then the bed particles are preheated, for example by an overbed burner or by preheating the primary air via a start burner which is placed in the wind box. The heated air is flowing through the bottom nozzles and into the ilmenite bed, heat is accumulated in the bed and the temperature of the bed is monitored by means of shielded thermocouples installed in the bed. When the bed temperature reaches around 550° C. a batch of biomass fuel is injected by starting the fuel feeding system with a pulse. The sequence of feeding fuel batchwise is carried out until ignition is achieved. Then the start burner is turned off and the fuel feeding is put into continuous feeding mode with increasing mass flow of fuel until the normal operating temperature in the bed is reached, which in this case is selected to be around 850-900° C.

Example 4

Pre-Oxidation of Ilmenite Using a Rotary Kiln

A rotary kiln is put into operation and the furnace is heated to a predetermined temperature of 800-900° C. in the reaction zone of the kiln during air excess. Air is continued to be supplied to maintain an oxidizing environment inside the furnace. Fresh ilmenite particles, for example rock ilmenite particles, are continuously fed from one side of the furnace and subjected to the oxidizing atmosphere inside the furnace. Pre-oxidized ilmenite particles are continuously removed from the other side of the furnace. The speed of rotation is adjusted to allow for a residence time of the ilmenite particles in the furnace of 1 to 2 hours.

Example 5

Pre-Oxidation of Ilmenite Using a CFB Boiler

By way of example, FIG. 1 shows a typical CFB boiler, which can be used for the production of pre-oxidized ilmenite particles. The reference numerals denote:

1 Fuel Bunker
2 Fuel Chute
3 Primary Combustion Air Fan
4 Nozzle Bottom
5 Primary Air Distributor
6 Secondary Air Ports
7 Fluidized Bed
8 Furnace
9 Cyclone
10 Loop seal
11 Immersed Superheater
12 Return Leg
13 Heat Exchangers
14 Flue Gas Treatment Plant
15 Flue Gas Recirculation Fan
16 Stack During normal operation, fuel is stored in the fuel bunker (1) and can be fed to the furnace (8) via a fuel chute (2). Alternative methods, such as pneumatic feeding and screw feeding (not shown) can also be used. The fluidization gas, in this case for example air, is fed to the furnace (8) as primary combustion air via the primary air distributor (5) from below the bed. Entrained particles are carried away by the fluidization gas stream and are then separated from the gas stream using a cyclone (9) and circulated back into the furnace (8) via a loop seal (10). Additional combustion air (so called secondary air) is fed into the furnace to enhance the mixing of oxygen and fuel. To this end, secondary air ports (6) are located throughout the furnace, in particular the freeboard (the part of the furnace above the dense bottom bed).

The CFB boiler can be utilized for producing pre-oxidized ilmenite particles. To this end, the boiler is started up and the furnace is heated to a predetermined operating temperature (800° C. to 900° C.). An oxidizing environment is maintained inside the furnace (8) by feeding of oxygen-containing gas (in this case for example air) via the primary air distributor (5) and preferably also the secondary air ports (6). When the operating temperature is reached, the continuous feeding of fresh ilmenite particles, preferably fresh rock ilmenite particles, is started via the fuel chute (2). The ilmenite particles are pre-oxidized by subjecting them to the oxidizing environment inside the furnace (8) at the predetermined temperature and pre-oxidized particles are continuously removed from the bottom of the boiler using the ordinary screw feeders for bottom ash removal (not shown).

The invention claimed is:

1. A method for starting up a fluidized bed boiler for operation with a bed material that comprises a predetermined concentration of ilmenite particles, the ilmenite particles comprising at least one rock ilmenite and sand ilmenite, the method comprising:

i) providing a bed material to the fluidized bed boiler; and ii) heating the bed material, wherein pre-oxidized ilmenite particles are provided to the bed material in the fluidized bed boiler before a predetermined operating temperature in the bed is reached.

2. The method of claim 1, comprising:

providing pre-oxidized ilmenite particles produced outside the fluidized bed boiler to the fluidized bed boiler; and/or providing fresh ilmenite particles to the fluidized bed boiler and pre-oxidizing said fresh ilmenite particles in the fluidized bed boiler.

3. The method of claim 1, comprising the steps of a) providing bed material to the fluidized bed boiler;

b) preheating the bed material;

c) monitoring temperature in the bed;

d) after the temperature in the bed has reached a predetermined fuel feeding temperature, batch-feeding fuel until ignition is achieved;

e) after ignition is achieved, starting continuous feeding of fuel at a fuel feeding rate and increasing the fuel feeding rate until the predetermined operating temperature in the bed is reached.

4. The method of claim 3, characterized by one or more of the following features:

the bed material provided in step a) comprises an inert bed material;

the bed material provided in step a) comprises silica sand;

the predetermined fuel feeding temperature in the bed is between 500° C. and 900° C.;

the predetermined fuel feeding temperature in the bed is between 500° C. and 600° C.;

the predetermined fuel feeding temperature in the bed is between 530° C. and 580° C.;

the predetermined operating temperature in the bed is between 750° C. and 950° C.; and the predetermined operating temperature in the bed is between 800° C. and 900° C.

5. The method of claim 2, wherein:

the pre-oxidized ilmenite particles are provided to the fluidized bed boiler before the bed material is preheated.

6. The method of claim 2, comprising gradually providing the fresh ilmenite particles to bed material heated in the boiler.

7. The method of claim 3, comprising replacing bed material provided in step a) with ilmenite particles until the predetermined concentration of ilmenite particles in the bed material is reached.

8. The method of claim 1, characterized by one or more of the following features:

the predetermined concentration of ilmenite particles in the bed material is at least 10 wt. % of the weight of the bed material;

the predetermined concentration of ilmenite particles in the bed material is at least 20 wt. % of the weight of the bed material;

the predetermined concentration of ilmenite particles in the bed material is at least 30 wt. % of the weight of the bed material;

the predetermined concentration of ilmenite particles in the bed material is at least 40 wt. % of the weight of the bed material;

the predetermined concentration of ilmenite particles in the bed material is at least 50 wt. % of the weight of the bed material;

the fluidized bed boiler is selected from the group consisting of a bubbling fluidized bed boiler and a circulating fluidized bed boiler;

the ilmenite particles are selected from the group consisting of rock ilmenite and sand ilmenite the ilmenite particles are rock ilmenite particles.

9. A method for using pre-oxidized ilmenite particles to reach a predetermined concentration of ilmenite particles in a bed material for operating a fluidized bed boiler, wherein:

i) pre-oxidized ilmenite particles are produced inside a furnace in a process comprising the steps of:

a) heating the furnace to a predetermined temperature;

b) maintaining an oxidizing environment inside the furnace;

c) feeding fresh ilmenite particles to the furnace;

d) pre-oxidizing the ilmenite particles by subjecting the ilmenite particles to the oxidizing environment inside the furnace at the predetermined temperature;

e) removing pre-oxidized ilmenite particles from the furnace;

wherein pre-oxidized ilmenite particles removed from the furnace are provided to the fluidized bed boiler to reach a predetermined concentration of ilmenite particles in the bed material before a predetermined operating temperature in the bed is reached;

and/or ii) fresh ilmenite particles are provided to the fluidized bed boiler and are heated to a temperature wherein the ilmenite particles are pre-oxidized, and wherein the pre-oxidized ilmenite particles are used to reach a predetermined concentration of ilmenite particles in the bed material before a predetermined operating temperature in the bed is reached.

10. The method of claim 9, characterized by one or more of the following features:

the predetermined temperature is between 500° C. and 1000° C.

the predetermined temperature is between 700° C. and 950° C.;

the predetermined temperature is between 800° C. and 900° C.;

the oxidizing environment inside the furnace is maintained by feeding oxygen containing gas into the furnace;

the oxidizing environment inside the furnace is maintained by feeding air into the furnace.

11. The method of claim 9, further comprising agitating the ilmenite particles inside the furnace; and/or monitoring a temperature inside the furnace.

12. The method of claim 9, characterized by one or more of the following features:

the ilmenite particles are subjected to the oxidizing environment for:

i) not more than 12 hours; and/or ii) at least 5 minutes;

iii) at least 30 minutes and/or not more than 60 minutes;

the concentration of oxygen in the oxygen: containing gas is between 0.5 vol. % and 30 vol. %;

the concentration of oxygen in the oxygen containing gas is between 2 vol. % and 21 vol. % the concentration of oxygen in the oxygen containing gas is between 3 vol. % and 8 vol. % the ilmenite particles are selected from the group consisting of rock ilmenite and sand ilmenite;

a temperature inside the furnace is monitored;

a feeding rate of fresh ilmenite particles to the furnace and/or a removal rate of pre-oxidized ilmenite particles are adjusted to keep a temperature inside the furnace essentially constant.

13. The method of claim 9, wherein:

the method is carried out using a bubbling fluidized bed boiler or a circulating fluidized bed boiler; or pre-oxidized ilmenite particles are produced inside the furnace using a rotary kiln.

14. The method of claim 5, wherein the pre-oxidized ilmenite particles are provided to the fluidized bed boiler at the predetermined concentration of ilmenite particles in the bed material.

15. The method of claim 6, wherein the fresh ilmenite particles are gradually added at a rate to keep the temperature in the bed essentially constant.

16. The method of claim 7, wherein in replacing bed material, a feeding rate for providing the fresh ilmenite particles is coordinated with a rate of removing bottom bed ash from the fluidized bed boiler.

17. The method of claim 11, wherein the ilmenite particles inside the furnace are agitated by stirring, rotation or by passing a gas stream through the ilmenite particles.

* * * * *